United States Patent [19]

Stevenson

[11] Patent Number: 4,485,800

[45] Date of Patent: Dec. 4, 1984

[54] STOVE CONSTRUCTION

[76] Inventor: Robert L. Stevenson, P.O. Box 370, Rogue River, Oreg. 97537

[21] Appl. No.: 539,794

[22] Filed: Oct. 7, 1983

Related U.S. Application Data

[63] Continuation of Ser. No. 320,859, Nov. 13, 1981, abandoned.

[51] Int. Cl.[3] ..... F24C 1/14

[52] U.S. Cl. ..... 126/77; 126/290; 126/112

[58] Field of Search ..... 126/77, 121, 61, 66, 126/60, 15, 65, 112, 67, 70, 290; 110/175 A, 175 R

[56] References Cited

U.S. PATENT DOCUMENTS

| | | | |
|---|---|---|---|
| 1,108,698 | 8/1914 | Castle | 126/77 |
| 2,530,095 | 11/1950 | Steven | 126/77 X |
| 4,212,286 | 7/1980 | Shane et al. | 126/77 |
| 4,267,817 | 5/1981 | Hicks et al. | 126/77 X |
| 4,300,526 | 11/1981 | McKay et al. | 126/77 X |
| 4,306,538 | 12/1981 | Friebar | 126/77 X |
| 4,320,741 | 3/1982 | Pierce | 126/123 |

*Primary Examiner*—Randall L. Green
*Attorney, Agent, or Firm*—Eugene M. Eckelman

[57] ABSTRACT

A firebox for a stove is defined by top, bottom, side and end walls and employs a loading door in one of the end walls. A main draft opening associated with an adjustable damper control is provided adjacent the lower portion of the firebox and an auxiliary draft opening associated with an adjustable damper control is provided adjacent the top portion of the firebox. In a preferred arrangement the main and auxiliary draft openings are disposed adjacent one of the end walls. Also, in a preferred arrangement, the auxiliary draft opening is disposed upwardly within at least the upper one-third of the firebox. The particular structure of the stove facilitates good combustion for heating but at the same time provides an efficient shut-down condition that will maintain a small holding fire without causing creosote to build up in the flue. The main draft opening is associated with a movable door arranged to be forced open in the event of pressure being developed in the firebox.

1 Claim, 5 Drawing Figures

STOVE CONSTRUCTION

This application is a continuation, of application Ser. No. 320,859, filed Nov. 13, 1981, now abandoned.

BACKGROUND OF THE INVENTION

This invention relates to new and useful improvements in stove constructions particularly of the type used in the home for heating purposes.

Various types of stoves have heretofore been employed and in view of the shortage and high cost of petroleum based fuel, stove designs have been proposed which are arranged to be sustantially air tight so that when closed down, the fire can be held at a minimum. By such process, the amount of fuel consumed is held to a minimum and also the fire can be maintained for long periods without stoking it. These tight stoves have a definite disadvantage, however, particularly when the fuel being used is wood, in that the lack of draft causes poor combustion and the chimney cools to the point at which the smoke condenses and collects on the interior of the chimney. In such conditions creosote is produced and if creosoting is allowed to continue, there will be a buildup of soot. A dangerous condition thus arises since it is possible that the soot will ignite to cause a chimney fire. To overcome this problem, some stove manufacturers recommend that the draft of the stove be opened wide once a day or so to allow the fire to burn hot. Such heated condition supposedly clears out small build-ups of creosote so that a chimney fire will not result.

Another disadvantage of air tight stoves is that when they are shut down, gases can collect in the firebox. Under certain conditions, these gases can ignite with such a force as to blow the stove pipe off the stove and thus create a dangerous condition as well as to produce damage from smoke or fire.

SUMMARY OF THE INVENTION

According to the present invention and forming a primary objective thereof, a stove is provided having a structure and draft arrangement which serve to maintain a holding fire for overnight or similar purposes but at the same time are capable of providing, without the frequent inconvenient process of temporarily providing a hot fire to burn out the creosote in the flue, conditions of combustion which are sufficient to prevent the build-up of creosote in the flue and which prevent the dangerous collection of gases in the firebox.

In carrying out the objectives of the invention, a firebox is provided which employs both a main draft opening and an auxiliary draft opening, the main draft being disposed adjacent a bottom portion of the firebox and the auxiliary draft opening being disposed adjacent the top of said firebox, the auxiliary draft opening preferably being located upwardly within at least the upper one-third of the firebox. The main and auxiliary draft openings have suitable controls, the main draft control being provided with a pressure relief door serving to discharge pressure that may build up in the firebox.

The invention will be better understood and additional objects and advantages will become apparent from the following description taken in connection with the accompanying drawings.

DETAILED DESCRIPTION OF A PREFERRED EMBODIMENT

Figure 1:
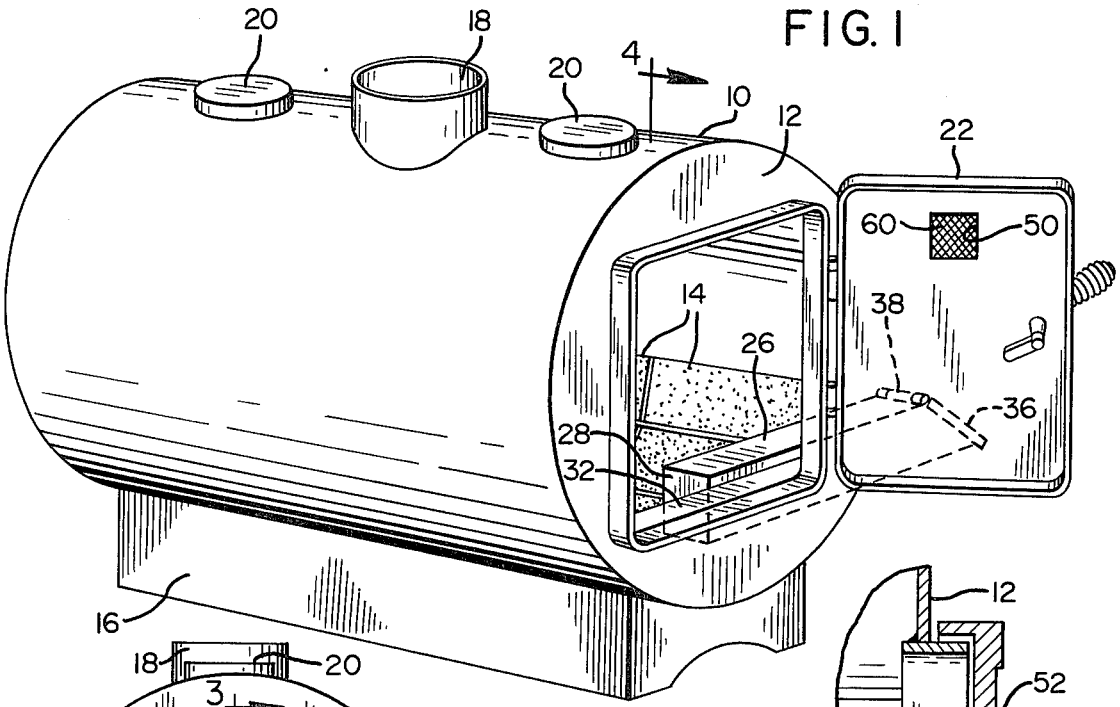
FIG. 1 is a perspective view of a stove apparatus employing principles of the present invention.

With particular reference to the drawings, the stove employs a firebox 10 having vertical end walls 12. The interior of the firebox may be lined with firebrick 14 if necessary. The firebox is supported on a suitable base 16 and has an upper smoke stack outlet 18 leading to the chimney flue, not shown. The firebox has one or more flat pot holding areas 20. One of the end walls 12 has a loading door 22.

Figure 4:
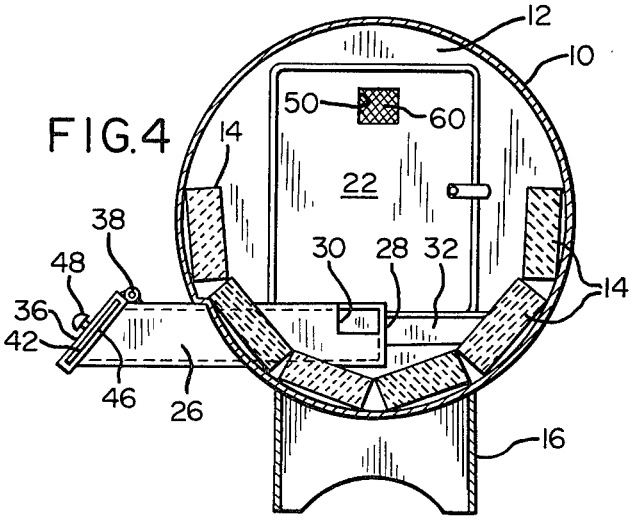
FIG. 4 is a cross sectional view taken on the line 4—4 of FIG. 1.
Figure 5:
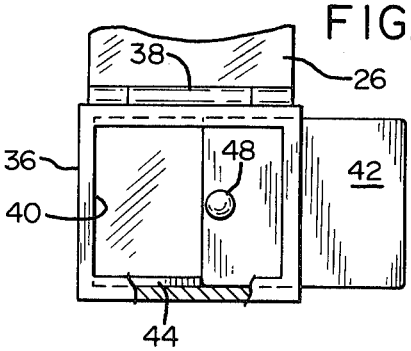
FIG. 5 is an enlarged fragmentary elevational view of the outer end of the main draft control of the stove.

The front of the firebox is associated with a draft tube 26 leading inwardly from one side. This draft tube projects through a suitable opening in the side of the firebox immediately adjacent the front wall 12 interiorly of the firebox. As best seen in FIGS. 1 and 4, tube 26 extends about halfway across the firebox. Such tube is fully closed around its sides and is also closed at its inner end 28. The outlet of the draft tube into the firebox comprises an opening 30 facing the rear of the firebox. Such opening comprises the main draft, and since it is disposed in a lower plane in the firebox, it provides a draft for good combustion. The size of the opening is smaller than the cross section dimension of the draft tube. Thus, since the draft flow area through the opening 30 is less than that of the tube 26, the opening 30 creates a Venturi effect wherein air being discharged therefrom travels at an increased velocity, thus inducing efficient combustion.

An ash guard 32 is disposed across the door opening between the wall 12 and draft tube 26.

Figure 2:
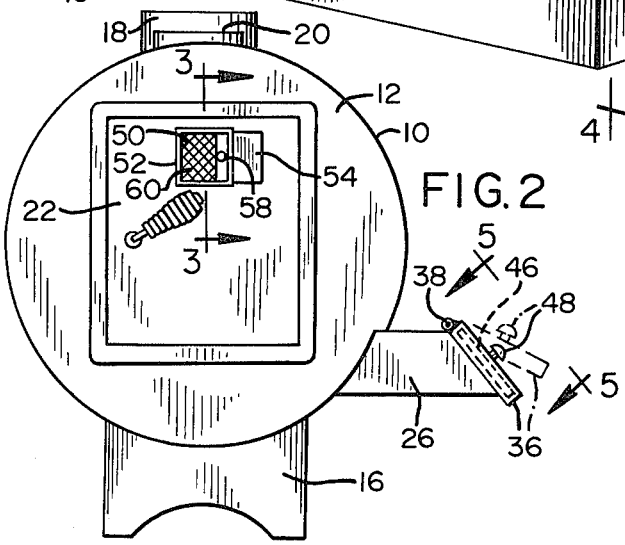
FIG. 2 is a front elevational view of the stove.
Figure 3:
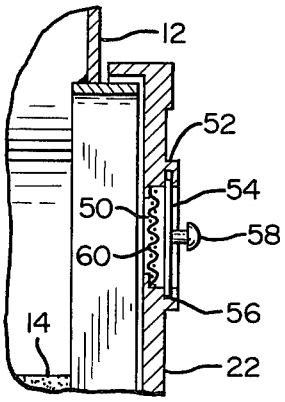
FIG. 3 is an enlarged fragmentary sectional view taken on the line 3—3 of FIG. 2.

The outer end of draft tube 26 is open and has a draft control door 36 disposed over such open end and arranged to close such open end. This outer end of the tube 26 is angled and the door 36 has a hinged connection 38 thereon across the top, whereby it normally lies in closed position across the open end of the tube by gravity. This gravity disposition of the hinged door 36 has the advantage that it will automatically lift if an undesirable pressure should develop in the firebox, such a lifted position being shown in broken lines in FIG. 2.

Door 36 has a front draft inlet opening 40 associated with a damper 42 having slidable guided movement in upper and lower guide tracks 44 and through an edge opening 46. A hand knob 48 is provided on the damper 42 for manual operation. The desired draft inlet into draft tube 26 can be precisely controlled by selected position of the damper 42. This draft comprises the main draft for combustion in the firebox and as is apparent, it may be totally closed if desired by fully closing the damper 42.

An auxiliary draft opening 50 is provided in the front of the stove, such opening being in the upper portion of the door. This draft opening is associated with a damper control 52 including a damper 54 having lateral slidable support in guide means 56 extending around three sides of the opening 50. The damper 54 projects laterally from the fourth side of the guide whereby to have slidable and controlled positioning over the opening. A hand knob 58 is provided on the damper 54 for manual adjustment. The opening 50 is covered with a screen 60 to prevent live coals from escaping from the firebox.

According to the invention, the main draft for combustion of material in the firebox enters through the draft tube 26 which as stated is adjacent the bottom of the firebox. The upper draft opening can be closed at this time or partially or fully opened as necessary for efficient combustion. When it is desired to provide a holding or night draft, damper 42 is partially or entirely closed and the upper draft opening 50 maintained by means of its control at a point that will allow only sufficient combustion to clear out the gases which may be caused from this shutdown and to prevent creosoting of the flue. In such holding combustion, damper control 54 will at least be open a slight amount, the size of opening depending upon the extent of shutdown desired. Although the fire may not hold quite as long as a substantially complete shutdown arrangement in a tight stove, the shutdown time that can be accomplished is generally adequate and still the dangerous build-up of creosote and explosive gases is absent. In the remote instance that gas pressure builds up in the firebox, it can escape through the hinged inlet door 36.

In order to accomplish the improved function of providing at least some combustion so as to clear out gases and to prevent creosoting, the auxiliary draft opening 50 is located adjacent the upper portion of the firebox and preferably upwardly within at least the upper one-third of the firebox.

The draft opening 50 may be located in an upper portion of the wall 12 instead of in the door if desired. The firebox may be of most any shape but a cylindrical configuration thereof has been found to be particularly effective in the operation of the auxiliary draft opening 50 since it provides for efficient accumulation of gases at the top and consequent disposal of the gases through the flue by the selected air movement through opening 50.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A stove construction comprising a longitudinally cylindrical firebox having vertical front and rear end walls, fire supporting means on the bottom of said firebox, a loading door in said front wall, a flue outlet positioned rearwardly of said front wall, a tubular main draft leading laterally into said firebox from the exterior immediately adjacent said front wall and at the lower portion of said door opening above said fire supporting means, said main draft having an inner portion in said firebox with an opening facing rearwardly of said firebox and disposed immediately above said fire supporting means, said opening in the inner portion of said firebox being of a size so as to have a draft flow capacity less than the draft flow capacity of said main draft to create an increased velocity of the draft in the area of its outlet into the firebox, adjustable damper control means on the exterior of said main draft, said damper control meains comprising a door having a movable connection with said main draft and arranged to be forced open in the event of pressure being developed in said firebox, said control means door having an adjustable damper control means thereon for supplying air to said main draft, an auxiliary draft in said loading door adjacent the top portion and centrally thereof, said loading door being dimensioned and said auxiliary draft being disposed such that said auxiliary draft is in an upper one-third of said firebox, and adjustable damper control means associated with said auxiliary draft.

* * * * *